US005493375A

United States Patent [19]

Moser

[11] Patent Number: 5,493,375

[45] Date of Patent: Feb. 20, 1996

[54] OIL CONTROL BLADE

[75] Inventor: Rabin Moser, Victor, N.Y.

[73] Assignee: Xerox Corporation, Stamford, Conn.

[21] Appl. No.: 314,751

[22] Filed: Sep. 29, 1994

[51] Int. Cl.[6] ..... G03G 15/20

[52] U.S. Cl. ..... 355/283; 355/284

[58] Field of Search ..... 355/283, 284; 118/60, 101, 104; 432/75

[56] References Cited

U.S. PATENT DOCUMENTS 4,214,549 7/1980 Moser ..... 118/60

5,200,786 4/1993 Fromm et al. ..... 355/284

FOREIGN PATENT DOCUMENTS 52-26836 2/1977 Japan ..... 35/284

56-5576 1/1981 Japan ..... 355/283

*Primary Examiner*—Joan H. Pendegrass

[57] ABSTRACT

A method and apparatus for preventing the buildup of release agent material on a fuser roll structure. Release agent material is removed from a pressure roll structure using a blade in contact therewith. The blade supported in contact with the pressure roll structure such that it moves the oil toward one end of the roll structure where it can be collected for reuse of for being discarded.

4 Claims, 2 Drawing Sheets

OIL CONTROL BLADE

BACKGROUND OF THE INVENTION

The present invention relates to fuser apparatus for electrostatographic printing machines and in particular to a method and apparatus for preventing the adverse affects of excess oil application.

In the process of xerography, a light image of an original to be reproduced is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an adhesive material, such as a silicone rubber or other low surface energy elastomer or, for example, tetrafluoroethylene resin sold by E. I. DuPont De Nemours under the trademark Teflon. In these fusing systems, however, since the toner image is tackified by heat it frequently happens that a part of the image carried on the supporting substrate will be retrained by the heated fuser roller and not penetrate into the substrate surface. The tackified toner may stick to the surface of the fuser roll and offset to a subsequent sheet of support substrate or offset to the pressure roll when there is no sheet passing through a fuser nip resulting in contamination of the pressure roll with subsequent offset of toner from the pressure roll to the image substrate.

To obviate the foregoing toner offset problem it has been common practice to utilize toner release agents such as silicone oil, in particular, polydimethyl silicone oil, which is applied to the fuser roll surface to a thickness of the order of about 1 micron to act as a toner release material. These materials possess a relatively low surface energy and have been found to be materials that are suitable for use in the heated fuser roll environment. In practice, a thin layer of silicone oil is applied to the surface of the heated roll to form an interface between the roll surface and the toner image carried on the support material. Thus, a low surface energy, easily parted layer is presented to the toners that pass through the fuser nip and thereby prevents toner from adhering to the fuser roll surface.

One method of applying a release agent such as silicone oil utilizes a combination donor/metering roll arrangement wherein the metering roll contacts silicone oil in a sump and conveys a metered amount to the donor roll. The metered layer of oil on the metering roll is transported to the donor roll and subsequently to a heated fuser roll. One such Release Agent Metering (RAM) system for applying silicone oils to a heated fuser roll is illustrated in U.S. Pat. No. 4,214,549. The system disclosed therein comprises a donor roll fabricated from a heat insulative and deformable material, for example, silicone rubber which transfers functional release material from a metering roll contacting a supply of release material contained in a sump to the heated fuser roll. A metering blade is supported in contact with the metering roll for metering the release material onto the metering roll to a thickness such that 1 micro liter of oil is dispersed per copy. This type of RAM system dispenses a fixed amount of release agent material to the fuser roll member.

In U.S. Pat. No. 5,200,786 granted to Fromm et al on Apr. 6, 1993, the donor roll of the '549 patent is replaced with a donor brush. As set forth in the '786 patent, the brush donor structure allows for the application of variable amounts of release agent material depending on the mode of operation. In other words, when color prints are being created a greater quantity of silicone oil is applied to the fuser roll compared to the amount applied when operating in the monochrome black mode.

In a donor brush RAM system, both fuser rolls (heated and backup) will reach an equilibrium with the oil on the metering roll unless the oil is removed. If a machine were required to handle a single size substrate the aforementioned equilibrium would not occur because the paper would continuously remove oil from the fuser roll. However, in machines where different size substrates are used a problem arises due to the application of oil over a length of the fuser roll corresponding to the largest (14 inch) paper size used. Thus, when shorter paper (11 inch) is used for extended run lengths, oil accumulates in an area outside the paper path. Oil accumulation must be prevented, otherwise oil will drip into the machine and/or cause deterioration of the fuser roll material when the outer surface of the fuser roll comprises silicone rubber. When roll deterioration occurs, a product of such deterioration is transferred to the longer paper. This results in the phenomena commonly referred to as red printout. Regardless of oil application rate, in the absence of paper, the fuser roll reaches an equilibrium with the metering roll, in both the "donor roll" or "donor brush" RAM systems. Oil thickness on the metering roll, in a donor roll RAM system, is approximately twice the steady state oil thickness on the fuser roll. Therefore, outside paper path, oil thickness is never more than twice. In a donor brush RAM system, oil thickness on the metering roll could be 10–20 times that of the steady state oil thickness of the fuser roll.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

SUMMARY OF THE INVENTION

Briefly, the present invention provides a method and apparatus for preventing release agent accumulation on a fuser roll.

As noted hereinabove, a problem arises when 14 inch paper is run through a fuser following an extended run of 11 inch paper. The problem occurs, under these conditions, because release agent oil builds up on the fuser roll outside the 11 inch paper path when running 11 inch paper.

One method of preventing such oil buildup would be to preclude application of oil outside the paper path when 11 inch paper is being used.

As set forth herein with respect to the present invention another approach is to remove release agent oil from the pressure or backup roll of a heat and pressure roll fuser apparatus. In accordance with the present invention, removal of release agent oil from the pressure roll is effected using a blade which contacts the surface of the pressure roll. The blade is fixedly supported in contact with the pressure roll such that the oil is moved toward one end of the roll.

BRIEF DESCRIPTION OF THE DRAWINGS

For a better understanding of the present invention, reference may be had to the accompanying drawings wherein the same reference numerals have been applied to like parts and wherein.

DESCRIPTION OF THE PREFERRED EMBODIMENT

Figure 1:
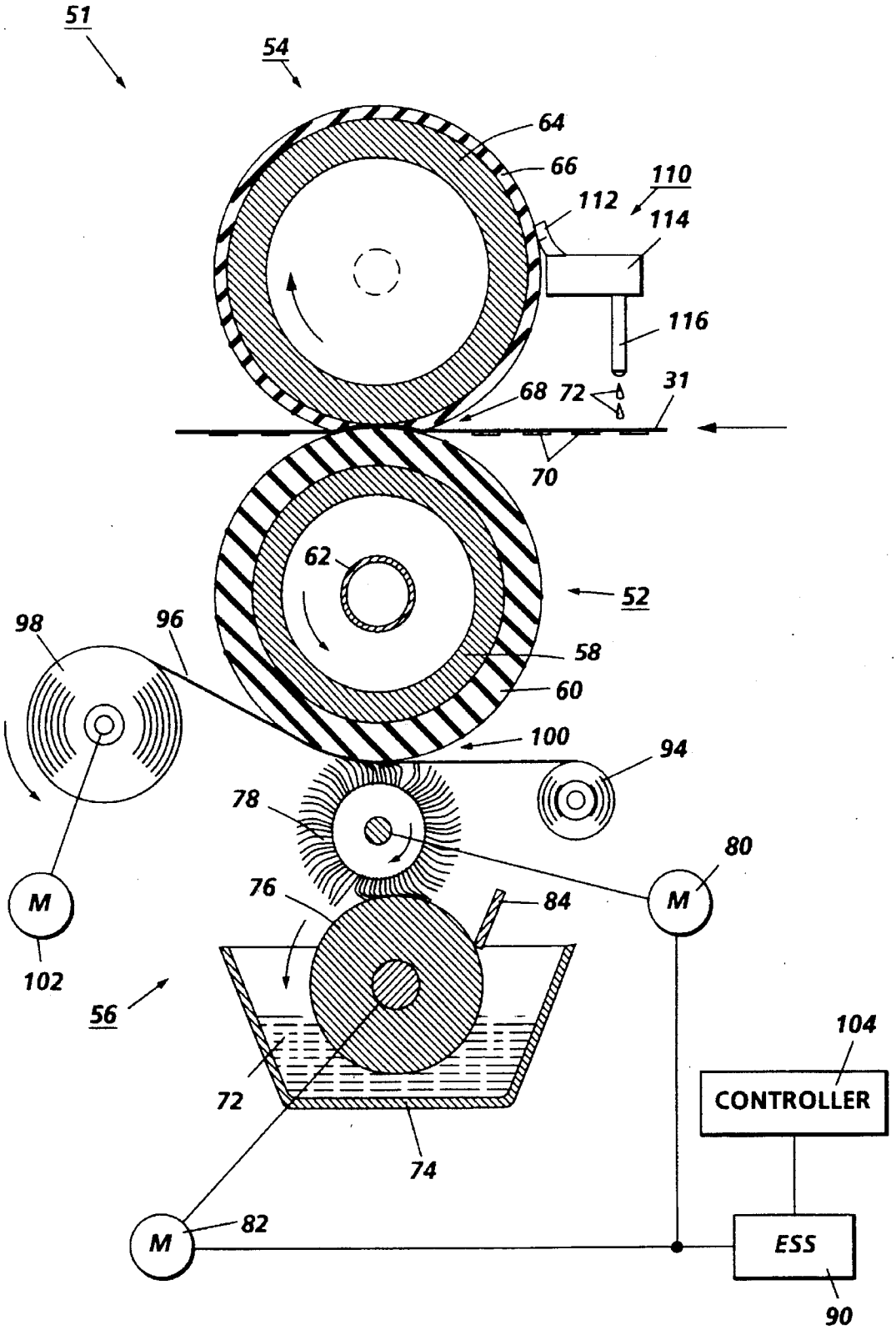
FIG. 1 is an end view of a fuser apparatus and release agent management system therefor.

Attention is now directed to FIG. 1 wherein a heat and pressure fuser apparatus 51 comprising a fuser roll structure 52 and pressure roll structure 54 are illustrated together with a Release Agent Management (RAM) system 56. As shown in FIG. 1, the fuser apparatus comprises the heated fuser roll 52 which comprises a core 58 having coated thereon a layer 60 of elastomeric material. The core 58 may be made of various metals such as iron, aluminum, nickel, stainless steel, etc., and various synthetic resins. Aluminum is preferred as the material for the core 58, although this is not critical. The core 58 is hollow and a heating element 62 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention, and the fuser member can be heated by internal means, external means or a combination of both. Heating means are well known in the art for providing sufficient heat to fuse the toner to the support. The elastomeric layer 60 may be made of any of the well known materials such as the RTV and HTV silicone elastomers as well as Viton (trademark of E.I. du Pont de Nemours & Co.).

The fuser roll 52 is shown in a pressure contact arrangement with the backup or pressure roll 54. The pressure roll 54 comprises a metal core 64 with a layer 66 of a heat-resistant material. In this assembly, both the fuser roll 52 and the pressure roll 54 are mounted on bearings (not shown) which are biased so that the fuser roll 52 and pressure roll 54 are pressed against each other under sufficient pressure to form a nip 68. It is in this nip that the fusing or fixing action takes place. The layer 66 may be made of any of the well known materials such as fluorinated ethylene propylene copolymer or silicone rubber.

An image receiving member or final support 31 having toner images 70 thereon is moved through the nip 68 with the toner images contacting the heated fuser roll 52. The toner material forming the image 70 is prevented from offsetting to the surface of the fuser roll 52 by the application of a release agent material such as silicone oil 72 contained in sump 74.

The sump 74 and silicone oil 72 form part of the RAM system 56. The RAM system 56 further comprises a metering roll 76 and a donor brush 78. The metering roll is supported partially immersed in the silicone oil 72 and contacts the donor brush for conveying silicone oil from the sump to the bristles of the donor brush 78. The donor brush is rotatably supported in contact with the metering roll and also in contact with the fuser roll 52. A metering blade 84 supported in contact with the metering roll 76 serves to meter silicone oil to the required thickness on the metering roll.

Whereas the contact of the donor roll of the '549 patent with its associated metering roll and the roll to which it delivers silicone oil is intimate (i.e. a high percentage of contact) the contact of the donor brush 78 with the fuser roll 52 and the metering roll 76 is only about 10%. The low percentage of contact between the donor brush and the other rollers provides for low torque transmission form the donor brush to the metering and fuser rolls. In operation, the donor brush tends to slide relative to the metering and pressure rolls and the area of contact therebetween is very low, approximately 10%.

The donor brush 78 may be operatively connected to the fuser roll to be driven thereby or it may be driven independently via a drive motor 80. The metering roll is operatively connected to a motor 82 for driving it independently of the fuser roll and donor brush. The metering roll is a smooth-surfaced metal roll on which the oil picked up from the sump is metered to the desired thickness by a metering blade 84. The metering roll is adapted to be driven at different speeds to deliver different oil quantities of oil. To this end the motor 82 is suitable for rotating the metering roll in the order of 5 to 100 RPM which is about 1 to 20% of the rotational speed of the pressure roll 54. The metering roll has a diameter of 20–75 mm and the donor brush has a diameter in the order of 20–40 mm.

The donor brush 78 is fabricated using heat-resistant fibers made of, by way of example, the copolymer of meta-phenylenediamine and isophthaloyl chloride. A loading pressure of 0.5 to 10 PSI causes the donor brush to conform to the surfaces of the pressure and metering rolls. At the forgoing speeds, the brush fibers serve to deliver in the order of 1 to 6 μl of silicone oil.

The speed of the metering roll is controlled by the motor 82 which is, in turn, controlled by the Electronic Subsystem (ESS) 90. The ESS comprises the necessary electronics and logic circuitry, well know in the art, to process control signals generated by a senor, not shown. The speed of the metering roll causes the metering roll to deliver somewhere between 1 to 6 μl of silicone oil to the donor brush in accordance with an algorithm forming a part of the ESS.

The liquid release agent delivery system or RAM (release agent management) system further comprises a supply roll 94, a dry web 96 and a take-up roll 98. The web supply roll 94 and web take-up roll 98 are supported in a housing (not shown) such that when a liquid release agent delivery system is in place, one of these rolls is on one side of the fuser roll 52 and the other roll or reel is on the other side thereof. The housing is mounted such that the web makes good contact with the fuser roll 52 along a path parallel to its longitudinal axis. The supply and take-up rolls are positioned above a nip 100 formed between the fuser roll 52 and the donor brush 78. A motor 102 operatively connected to the take-up roll 98 serves to transport web material from the supply roll. Such positioning of these rolls provides firm pressure engagement of the web 62 with the fuser roll 52. By dry is meant that the web when initially installed is devoid of release agent oil.

Release agent oil 72 contained in a sump 74 is applied to the web 96 by means of the donor brush bristles. The brush is adapted to be rotated such that the bristles move in contact with the metering roll 76 and then into contact with the web 96. Rotation of the brush is accomplished via motor 80 which can be rotated at variable speeds depending upon the mode of operation of the machine in which the fuser is utilized.

Any suitable web material capable of withstanding fusing temperatures of the order of 225° C. may be employed. The web material may be woven or non-woven and is of a sufficient thickness to provide a minimum amount of release agent for a desired life. It should be understood that the principle functions of the web are the delivery of the release agent oil to the fuser roll and, in addition, removal of toner and other contaminants form the fuser roll surface.

The liquid release agent may be selected from those materials which have been conventionally used. Typical release agents include a variety of conventional used silicone oils including both functional and non-functional oils. Thus, the release agent is selected to be compatible with the rest of the system. A particularly preferred release agent is an unimodal low molecular weight polysiloxane having a viscosity of about 11,000 centistokes. Such a release agent when used in a release agent delivery system a described above wherein about a 0.07 millimeter thick web is impregnated with at least 25 grams per square meter of release agent and a 20 millimeter diameter open celled, silicone rubber foam roll is also impregnated with the release agent, is consumed at a rate of about 0.3 microliters per copy.

The application of oil to the web via the brush, as will be appreciated, results in an adequate amount of oil being available for high volume and color imaging thereby preventing fuser roll degradation due to an insufficient oil supply. The addition of oil will also increase the fuser roll release life for a low volume machine. Any excess oil conveyed to the web which may drip due to the force of gravity is returned to the sump which is supported therebeneath for that purpose.

A controller 104 (FIG. 2) operatively connected to ESS 90 serves to control the speed of the motor 80 and, in turn, the speed of rotation of the donor brush.

Figure 2:
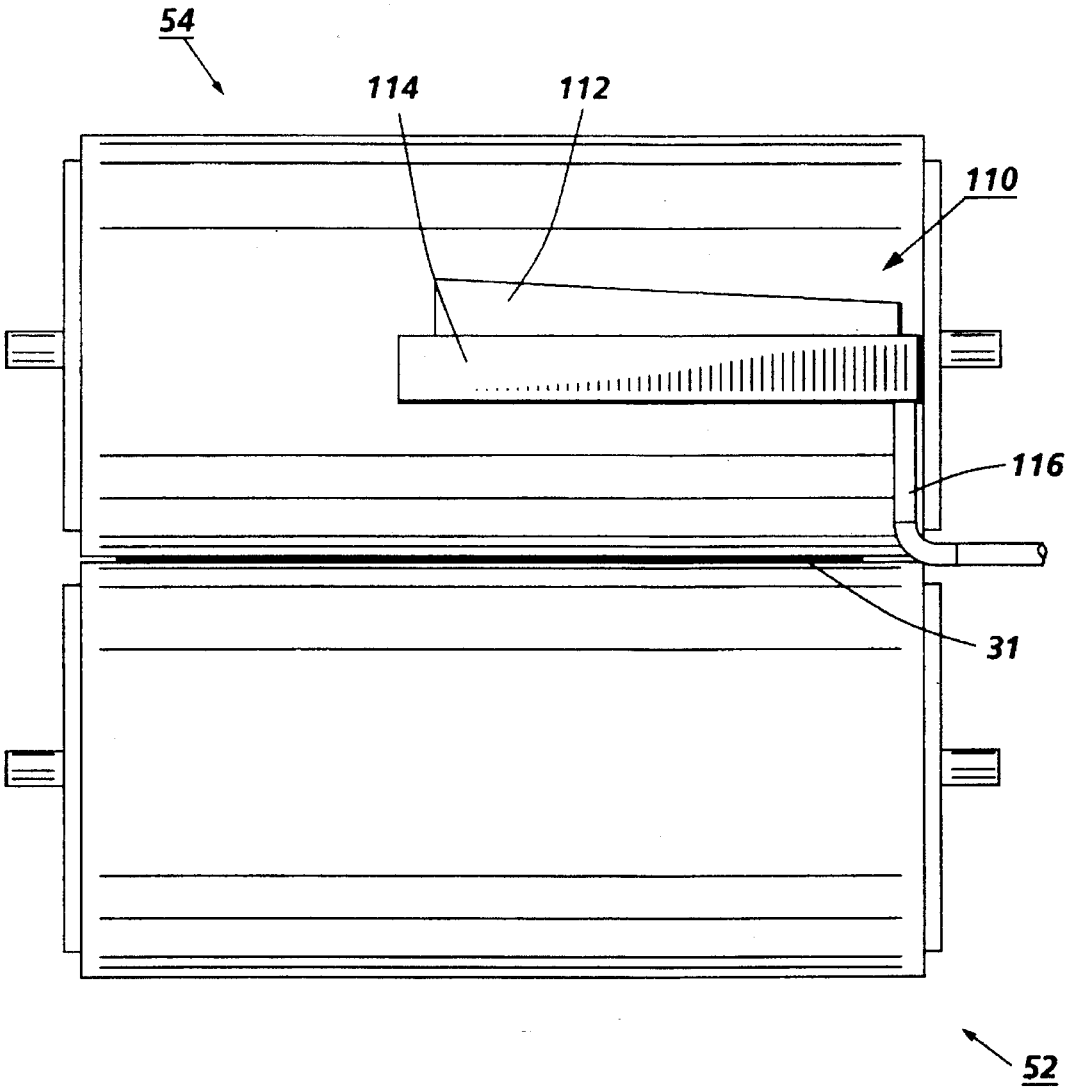
FIG. 2 is a view of the fuser apparatus of FIG. 1, having been rotated 90°.

A blade structure 110 including a blade 112 and a blade holder 114 is mounted such that the blade contacts the pressure roll 54 as shown in FIG. 2. As can be seen in FIG. 2, the blade 112 is canted toward the right so that release agent oil 72 is moved toward the one end of the pressure roll 54. The oil so moved is directed to a drain 116 for recirculation of the oil. While not shown, the drain can be connected to the sump 74 via a suitable conduit structure and a pump for conveying the oil to the sump from the drain.

I claim:

1. Apparatus for fusing toner images to substrates such as plain paper, said apparatus comprising:

means for applying release agent material to a predetermined length of a heated fuser member;

a pressure member contacting said heated fuser member;

means for passing substrates between said two members, said substrates having a dimension less than said predetermined length which dimension defines a paper path relative to said heated fuser member; and a blade structure contacting said pressure member in an area corresponding to an area on said fuser member which is outside said paper path for preventing release agent buildup on said fuser roll in an area outside of said paper path.

2. Apparatus according to claim 1 wherein said blade structure is positioned at an angle relative to a longitudinal dimension of said pressure member such that release material is directed to an end of said pressure member.

3. Apparatus according to claim 2 including means for conveying release agent that has been directed to said end away from said said pressure member.

4. Apparatus according to claim 3 wherein said fuser and pressure members comprise roll structures.

* * * * *